United States Patent [19]

La Conte

[11] 4,412,618

[45] Nov. 1, 1983

[54] TRAY FOR GROOMING INSTRUMENTS

[76] Inventor: Ruth A. La Conte, 4529 N. Cramer, Whitefish Bay, Wis. 53211

[21] Appl. No.: 306,603

[22] Filed: Sep. 29, 1981

[51] Int. Cl.[3] ..... B65D 1/36; B65D 6/04; C82F 1/70; C82F 3/00

[52] U.S. Cl. ..... 206/581; 211/13; 211/60 T; 206/373; 220/20; 132/79 R

[58] Field of Search ..... 206/349, 373, 372, 581, 206/207; 220/23, 20; 132/79 R; 211/13, 60 T

[56] References Cited

U.S. PATENT DOCUMENTS

| | | | |
|---|---|---|---|
| 1,847,572 | 3/1932 | Rich . | |
| 2,456,850 | 12/1948 | Willis . | |
| 2,561,681 | 7/1951 | Wise . | |
| 2,634,801 | 4/1953 | Strok . | |
| 2,988,229 | 6/1961 | Cohen et al. . | |
| 3,239,069 | 3/1966 | Hollins | 206/581 |
| 3,460,899 | 8/1969 | Miller | 220/23 |
| 3,698,404 | 10/1972 | Greco | 132/79 R |
| 3,719,283 | 3/1973 | Urda | 211/13 |
| 4,021,197 | 5/1977 | Brooks | 206/207 |

*Primary Examiner*—William T. Dixson, Jr.
*Attorney, Agent, or Firm*—Andrus, Sceales, Starke & Sawall

[57] ABSTRACT

A tray for removably holding grooming instruments includes a hollow housing having an inclined front wall, an inclined top wall sloping downwardly in the opposite direction from the apex of the front wall, and a plurality of upstanding side walls supporting the front and top walls. The front and top walls each include a recess at their lower ends for horizontally retaining grooming instruments. The front wall includes a plurality of spaced openings formed in its upper portion and located in horizontally and vertically spaced planes with each opening adapted to longitudinally receive a grooming instrument. An elongate compartment is associated with each opening and extends into the interior of the housing from the inner surface of the front wall to support a grooming instrument so that it projects lengthwise from the front wall in an inclined position.

4 Claims, 3 Drawing Figures

1
8
3
5a
21
11
25
30
22
32
2
31
10
9
23
33
34
4
5
26
24
56
28
6a
27
29
6
17
7
6b

8
A
B
11
5a
1
35
16
3
12
13
10
9
14
2
12
15
4
18
17
36
19
7
37

5
9
7
5b
2
2
12
2
7
11
3
1
8
4
10
12
19
37
18
17
6
6b

TRAY FOR GROOMING INSTRUMENTS

BACKGROUND OF THE INVENTION

The present invention relates to a receptacle for tools, and more particularly to a portable tray for removably holding grooming instruments, such as combs, brushes, scissors and the like in an organized and readily accessible manner.

One of the primary concerns in designing receptacles for holding grooming instruments is to provide a structure that maintains the various instruments in a predetermined neat and orderly arrangement in a position where they are readily accessible. Other objects include providing a portable device that is simple in construction, easy to use, is compact and light in weight and inexpensive to manufacture.

Various arrangements have been developed in the past for holding grooming instruments. See, for example, U.S. Pat. Nos. 4,021,197, 3,719,283, 3,460,899, 2,988,299 and 2,456,850. Nevertheless, there remains a need for an improved receptacle for use in barber shops and beauty salons.

SUMMARY OF THE INVENTION

A tray for removably holding grooming instruments comprises a hollow housing having an inclined wall with a plurality of spaced apart openings formed in the wall, and support means defining a compartment associated with each of the openings. Each of the compartments is adapted to longitudinally receive an instrument therein so that it projects lengthwise from the wall in an inclined position. The predetermined spacing of the openings in the inclined wall permits individual, selective removal of the desired implement. The implements are also easily identifiable and accessible to a user since each is longitudinally orientated in an inclined position.

The inclined wall is preferably the front of the tray, and includes a trough formed therein for horizontally retaining grooming instruments. The trough extends across the entire lower portion of the front of the tray and provides easy access to a user for removing the desired instrument when needed. The trough also includes a lip formed along its front edge which aids in retaining the instruments therein.

The tray also includes a second inclined wall having an abutment along its lower end that forms a recess for horizontally retaining additional grooming instruments therein. In one form, the second inclined wall is the top of the tray and slopes downwardly in the opposite direction from the apex of the inclined front wall with the slope of the inclined top wall. A plurality of upstanding side walls support the sloping front and top walls in their inclined positions, and provide an attractive tray which is compact and portable.

The tray may also be molded in one piece of plastic material which provides a device that is light in weight and inexpensive to manufacture.

The present invention thus provides an improved tray for removably holding various grooming instruments. Other objects and advantages of the present invention will appear during the course of the following description.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
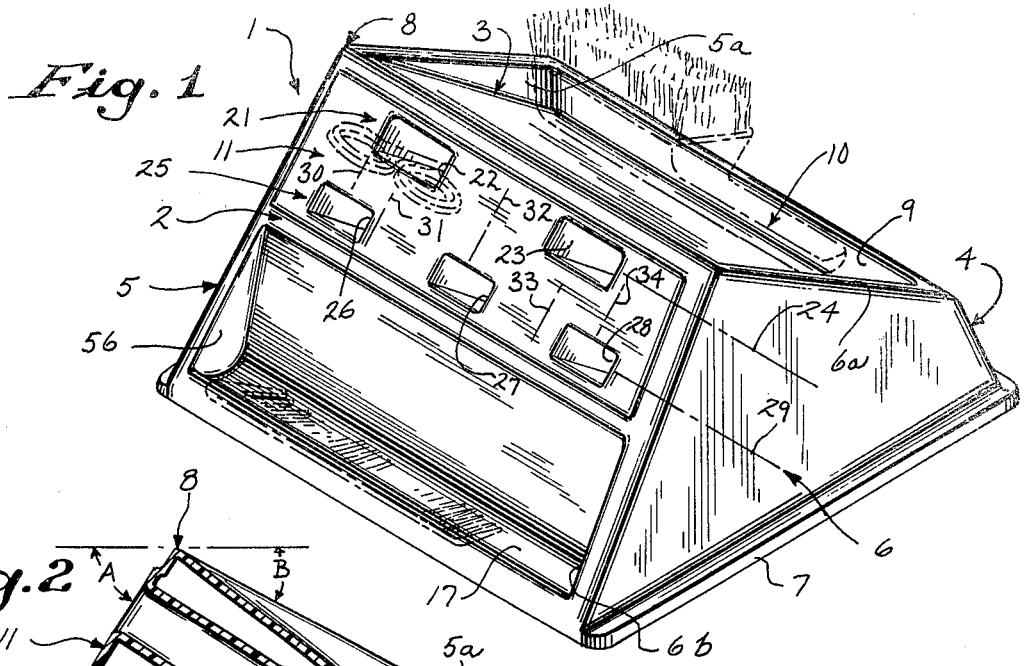
FIG. 1 is a perspective view of a tray for removably holding grooming instruments constituting a preferred embodiment of the invention.

A tray 1 for removably holding grooming instruments includes a hollow housing having an integrally joined inclined front wall 2, an inclined top wall 3, an upstanding rear wall 4 and a pair of upstanding side walls 5 and 6. The rear wall 4 and side walls 5 and 6 support the front wall 2 and top wall 3 in their inclined positions. In one practical construction, the tray 1 has a length of about 8.0 inches, a width of about 8.0 inches, and a height of about 4.25 inches. The tray 1 has an open bottom which reduces its overall weight, and includes a ridge 7 projecting along the lower edge margins of walls 4–6 to provide a base for the tray 1. The base, however could be provided by other supporting structure.

Figure 2:
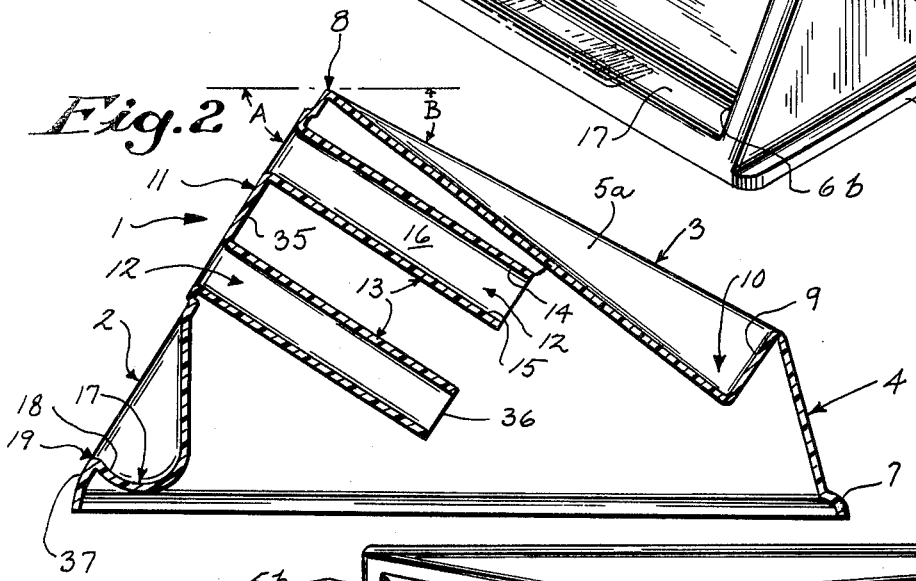
FIG. 2 is a side view in cross section of the tray taken along the plane of the line 2—2 of FIG. 1.

The top wall 3 slopes downwardly from an apex 8 of tray 1 to the supporting rear wall 4, as illustrated in FIG. 2. The top of rear wall 4 provides an abutment 9 at the lower end of inclined wall 3 which forms a recess 10 that extends substantially the entire width of tray 1. The top edges *5a* and *6a* of side walls 5 and 6, respectively, extend above wall 3 and run longitudinally from apex 8 to the top of rear wall 4 to enclose the sides of recess 10. The recess 10 horizontally receives and retains various grooming instruments, such as brushes, combs, razors or other implements.

The front wall 2 is inclined or sloped downwardly from apex 8 in the opposite direction from that of top wall 3. As seen in FIG. 2, the slope or angle "A" of inclination of the front wall 2 is much greater than the slope or angle "B" of inclination of the top wall 3. Preferably, the front wall 2 slopes at an angle "A" of about 50 to 60 degrees while the top wall 3 slopes at an angle "B" of about 25 to 35 degrees from a horizontal line running through the apex 8 of tray 1.

Figure 3:
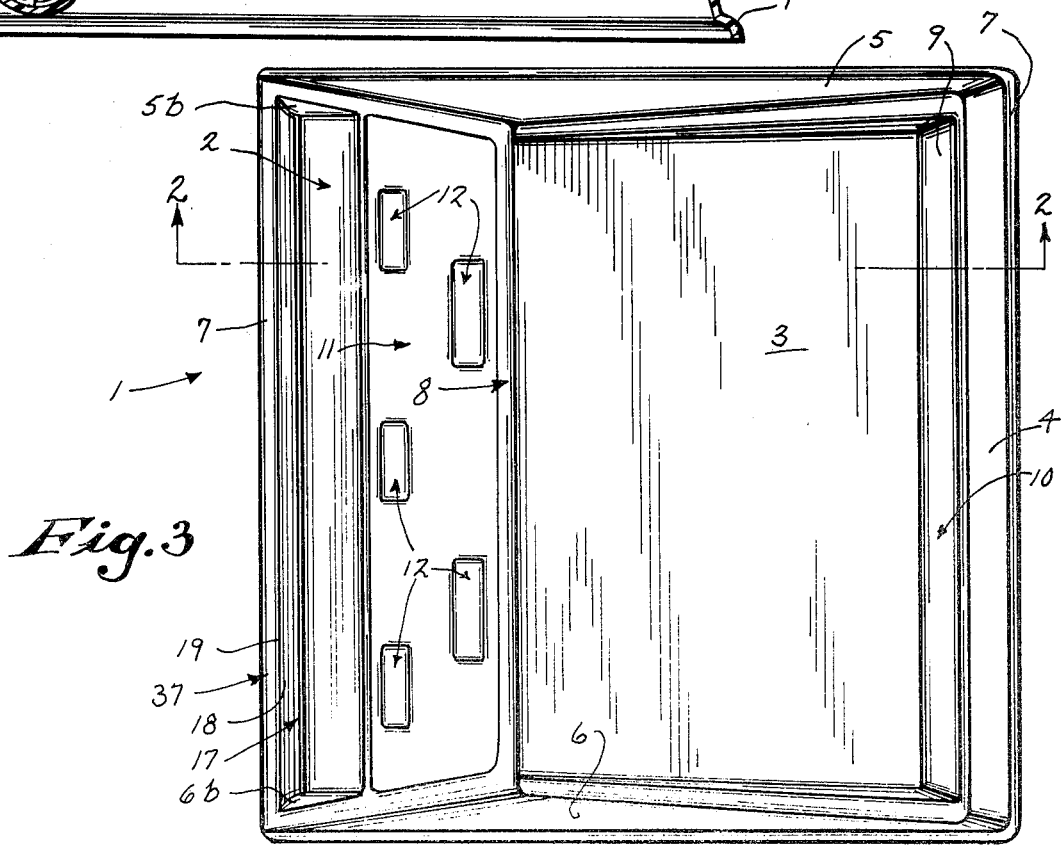
FIG. 3 is a plan view of the tray of FIG. 1.

The upper portion of inclined wall 2 includes a panel 11 having a plurality of spaced apart rectangular shaped openings 12 formed therein. As seen in FIG. 3, the tray 1 contains five openings 12 arranged in two horizontal rows across the width of tray 1. A top row 21 has two spaced openings 22 and 23 located within a first horizontal plane 24 while a lower row 35 has three spaced openings 26, 27 and 28 located within a second horizontal plane 29 which is vertically spaced from horizontal plane 24. A horizontal center of each of the openings 22, 23, 26, 27 and 28 is located within respective horizontally spaced vertical planes 30, 31, 32, 33 and 34, thereby providing a horizontal offset for such openings to enhance the access to the instruments retained in such openings. As shown, the cross-sectional area of the openings 22 and 23 in the upper row is greater than the cross sectional area of the openings 26, 27 and 28 in the bottom row. Thus, various sized grooming instruments may be accommodated by the openings 12. The openings 12 are preferably slightly larger in their dimensions than the instruments which they accommodate so that the instruments can be easily removed and inserted therein.

The tray 1 also provides a means for supporting the grooming instruments inserted into the openings 12. This support is provided by a plurality of compartments 13, one of which is associated with each opening 12. Each compartment 13 preferably extends into the interior of the housing, i.e. about three inches in one practical construction, from the inner surface 35 of front wall 2, and is open at its lower end 36 which enables moisture to escape or drain from the instruments contained therein. As seen in FIG. 2, each compartment 13 is an elongate structure having its length substantially greater than its cross-section. Each compartment 13 has a rectangularly shaped cross-section which is co-extensive with its corresponding opening 12 and includes a top portion 14 projecting from the top edge of opening 12, a bottom portion 15 projecting from the bottom edge of opening 12, and a pair of side portions 16 projecting from the side edges of opening 12. Each compartment 13 thus forms a tubular structure and extends perpendicular to the plane of front wall 2. The compartments 13 may also extend at an inclined angle with respect to front wall 2 depending upon the angle of inclination desired for grooming instruments projecting from openings 12.

Each opening 12 and corresponding compartment 13 longitudinally receives a grooming instrument which projects lengthwise from an opening 12 in front wall 2 in an inclined position. The openings 12 and compartments 13 preferably function to removably retain scissors which have their blades inserted into the compartments 13 so that their looped handles extend from front wall 2. As seen in FIG. 2, the tip of a scissor will extend through the open lower end 36 of each compartment 13 thus permitting moisture to escape from the compartments 13.

The inclined front wall 2 also includes a trough 17 disposed in its lower portion which extends substantially the width of the tray 1. The trough 17 functions to removably retain combs, brushes, razors and like implements in a horizontal position for easy access by a user. The trough 17 forms a recess in front wall 2 and includes an arcuate-shaped bottom wall or abutment 18. Such bottom wall 18 extends lower than the front edge 37 of trough 17 and thus forms a lip 19 extending substantially the entire width of tray 1 which aids in retaining instruments therein. The trough 17 is enclosed at its opposite ends by side wall portions **5*b* and 6*b* of side walls 5 and 6**, respectively.

The upstanding side walls 5 and 6 extend between front wall 2 and top wall 3 to support such walls in their inclined positions, while the upstanding rear wall 4 extends between side walls 5 and 6 and top wall 3 for enclosing the back of tray 1. The walls 4–6 thus provide support for the inclined walls 2 and 3 and enclose the tray 1 while further providing an attractive design that is appealing to the eye.

A preferred embodiment of a tray for removably holding grooming instruments has been shown and described. Various modifications and substitutions may be made for the components described. For example, the degree of slope for front wall 2 and top wall 3 may be varied.

Various modes of carrying out the invention are contemplated as being within the scope of the following claims, particularly pointing out and distinctly claiming the subject matter which is regarded as the invention.

I claim:

1. A tray for removably holding grooming instruments, comprising:

a first wall operatively connected to a base and located in a plane inclined with respect to said base, said first wall including an upper portion having a plurality of spaced openings and a lower portion having a trough formed therein for horizontally receiving a grooming instrument therein, a second wall located in a plane inclined with respect to said base, said second wall sloping downwardly from the apex of said first wall in a direction opposite from said first wall and including an abutment at the lower end of said second wall to form a recess for horizontally receiving a grooming instrument therein, said second wall further including a pair of opposite end walls extending between said apex and said abutment for enclosing the sides of said recess, support means providing an elongate tubular compartment associated with each of said openings and extending from the inner surface of said first wall to longitudinally retain a grooming instrument projected lengthwise from said first wall in an inclined position with respect to said base, each of said compartments having a length substantially greater than its width and an open bottom, and a plurality of side walls supporting said first and second walls.

2. The tray of claim 1, wherein said openings are in horizontal alignment.

3. The tray of claim 1, wherein said trough includes a lip formed along its front edge to retain said grooming instrument.

4. The tray of claim 1, wherein the slope of said second wall is different from that of said first wall.

* * * * *